US006696122B1

(12) United States Patent
Deschamps

(10) Patent No.: US 6,696,122 B1
(45) Date of Patent: Feb. 24, 2004

(54) TEMPORARY SURFACE COVERING

(75) Inventor: Georges-Paul Deschamps, Angouleme (FR)

(73) Assignee: Etablissements A. Deschamps & Fils., La Couronne (FR)

( * ) Notice: Subject to any disclaimer, the term of this patent is extended or adjusted under 35 U.S.C. 154(b) by 0 days.

(21) Appl. No.: 09/646,604

(22) PCT Filed: Mar. 19, 1999

(86) PCT No.: PCT/FR99/00647

§ 371 (c)(1),
(2), (4) Date: Nov. 13, 2000

(87) PCT Pub. No.: WO99/49116

PCT Pub. Date: Sep. 30, 1999

(30) Foreign Application Priority Data

Mar. 20, 1998 (FR) ..... 98 03703

(51) Int. Cl.[7] ..... D03D 23/00

(52) U.S. Cl. ..... 428/36.1; 428/54; 428/141; 442/239; 238/14; 404/35; 404/36; 180/9

(58) Field of Search ..... 428/34.2, 35.7, 428/36.1, 54, 141; 442/239, 244; 238/14; 404/35, 36; 180/9

(56) References Cited

U.S. PATENT DOCUMENTS 1,004,861 A * 10/1911 A. Ek. ..... 238/14
1,617,271 A * 2/1927 Penfield ..... 238/14
1,746,709 A * 2/1930 Marshall ..... 441/129
3,999,879 A * 12/1976 Stachiw et al. ..... 14/27

FOREIGN PATENT DOCUMENTS

DE 3929284 A1 * 4/1991 ..... A01G/9/22
EP 0617160 A1 * 2/1993 ..... D06N/7/00
WO WO 95/26435 * 5/1995 ..... D03D/23/00

* cited by examiner

*Primary Examiner*—Harold Pyon
*Assistant Examiner*—Alicia Chevalier
(74) *Attorney, Agent, or Firm*—Young & Thompson

(57) ABSTRACT

A temporary surface covering with a woven structure formed of warp threads and weft threads and whose weave is such that each warp thread intersects or intertwines with the following weft threads, and a second auxiliary woven structure being superposed having a layer of warp threads and a layer of weft threads, the connection between the two woven structures being carried out in the course of a same weaving operation simultaneously with the overlapping of the structures, so as to constitute between the two structures, from place to place, tubular pockets oriented in the direction of the warp threads or in the direction of the weft threads, the pockets serving for the reception of elements devoted to various uses.

19 Claims, 1 Drawing Sheet

TEMPORARY SURFACE COVERING

BACKGROUND OF THE INVENTION

The present invention relates to an improvement in the type of temporary surface covering particularly for movement of vehicles on sandy, muddy or marshy ground, which is the object of French patent No. 2 718 158 in the name of the applicant.

DESCRIPTION OF THE RELATED ART

The above patent discloses a covering characterized in that it is constituted by a woven structure formed from weft threads of the monofilament type disposed in a single layer and warp threads also disposed in a single layer, the weave of the woven structure being such that each warp thread intertwines with the following weft threads, preferably and very proximately, half of the intersections of the rows and columns of the weave, the warp thread being left in the remaining intersections, such that for each warp thread, there is obtained at least one single and tight weave region followed by a float region, the alternation of the above different zones giving rise to retightening the weft threads creating a substantial relief of the fabric thus produced.

For certain applications, it appears to be useful or necessary to improve the load-bearing capacity of this covering so as particularly to reduce the phenomenon of rutting that can result from the conjunction, on the one hand, of the inconsistent nature of the ground, and, on the other hand, of the weight of the vehicle and its mode of movement over the ground.

From EPO 617 160 there is known a composite covering structure constituted by a woven structure clad on its two surfaces with an elastomeric layer.

From place to place in this composite structure are provided pockets adapted to receive flexible or rigid elements, or to be inflated with the help of a fluid under pressure.

To this end, certain of the warp and weft threads of the woven structure are separated from the other threads so as locally to divide the original woven structure.

Such a covering structure is necessarily made fragile in line with the pockets and its physical properties are very substantially modified and altered because of the loss of integrity of the woven structure adjacent the pockets.

SUMMARY OF THE INVENTION

The present invention has precisely for its object to overcome the drawbacks of the above coverings.

To this end, the invention has for its object a temporary surface covering, particularly for the movement of vehicles over sandy, muddy or marshy ground, of the type with a woven structure formed of warp and weft threads whose weave is such that each warp thread intersects or intertwines with following weft threads, preferably and very proximately, half the intersections of the rows and columns of the weave, the warp thread being left at the remaining intersections, such that, for each warp thread, there is obtained at least one region of simple and tightened weave followed by a region of floats, characterized in that a second auxiliary woven structure is superposed and comprises a layer of warp threads and a layer of weft threads, the connection between the two woven structures being effected in the course of a same weaving operation simultaneously with the overlapping of the structures, so as to constitute between the two structures, from place to place, tubular pockets oriented according to the warp threads or according to the weft threads, said pockets serving for the reception of elements provided for various purposes.

According to an application of the invention to the reinforcement of the rigidity of the covering, the pockets thus constituted receive at least one elongated rigidification element, for example a bar of composite material of several tens of millimeters in diameter.

Such bars, and particularly when they are inserted in the pockets constituted transversely to the covering, which is to say parallel to the weft threads, substantially improve the load-bearing capability whilst reinforcing the gripping of the contacting surface in particular with the tires of vehicles moving on such a covering.

When the pockets are provided in the direction of the warp threads, along the longitudinal axis of the covering, the elements constituted for example by flexible tubes inflated by a fluid under pressure, permit conferring on the assembly of the covering a substantial rigidity and a high stability.

Other applications of the device of the invention can be envisaged, for example the detection in or on the ground on which the covering is deployed, or dangers such as mines or hidden pits, in which case the pockets constituted in the covering can receive any detection means or device and/or device for the destruction of mines.

BRIEF DESCRIPTION OF THE DRAWINGS

Other characteristics and advantages will appear from the description which follows of embodiments of the invention, which description is given solely by way of example and with respect to the accompanying drawings, in which.

DESCRIPTION OF THE PREFERRED EMBODIMENTS

Figure 1:
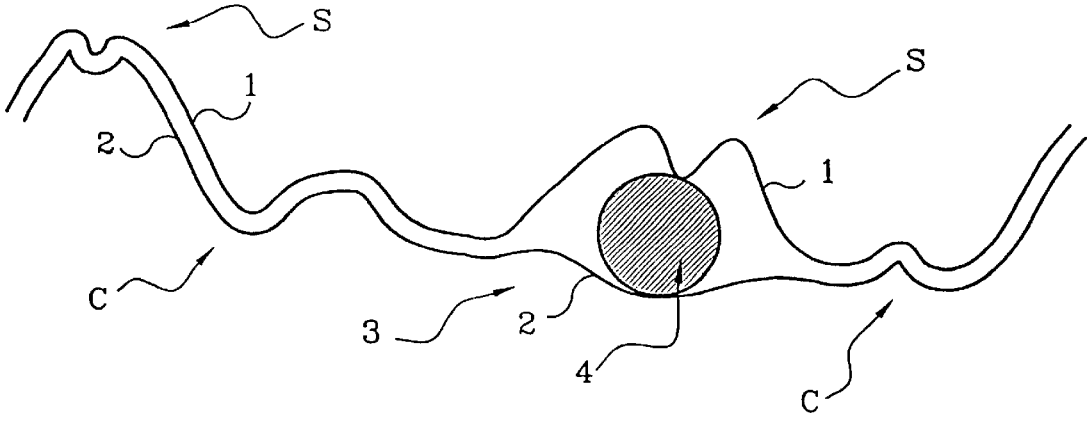
FIG. 1 is a very schematic and partial view of the section of the assembly according to the invention comprising two superposed woven structures.

In FIG. 1 there is schematically shown at numeral 1 the profile through a woven structure forming a covering, of the type described in French patent 2.718.158.

This covering has on its two surfaces an embossed structure with transverse ribs formed by projections S and hollows C, which gives to the covering its properties of gripping vehicles tires that move over this covering.

According to the invention, to this woven structure 1 is added, in superposition, a second woven structure shown at 2, constituted by a layer of warp threads and layer of weft threads, these threads being parallel to the corresponding threads of the structure 1.

Two woven structures 1 and 2 are made and connected to each other in the course of a same weaving operation, in the course of which are constituted pockets such as those shown at 3 in FIG. 1, by localized separation of the two woven structures 1 and 2, for example in line with the projections S. To this end, the two layers of warp threads for the two woven structures 1, 2 are unrolled from two separate warp thread feeding rollers and brought to a weaving machine provided with two dobbies each associated with one of the two layers and working simultaneously and in coordination to carry out the overlapping of the two layers and their localized separation in line with the pockets to be provided, under the control of a suitable program. Such a weaving-assembling technique of two woven structures is conventional.

Figure 2:
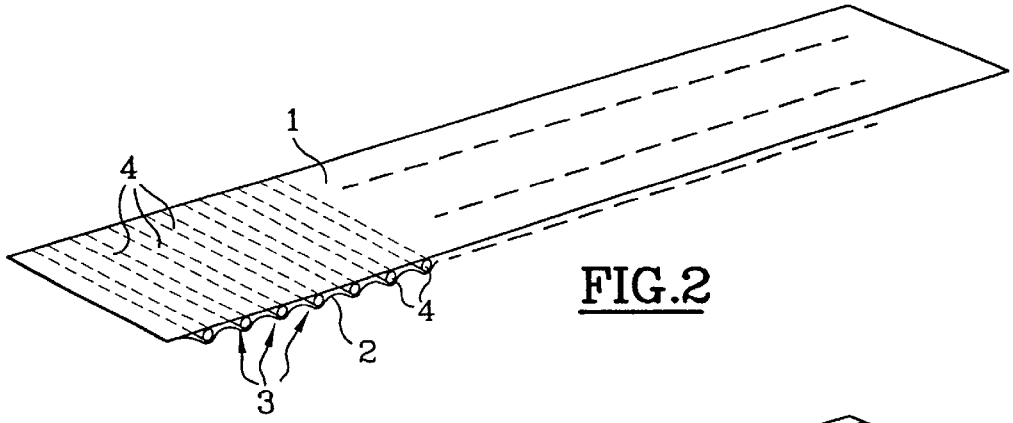
FIG. 2 is a perspective view of a covering according to the invention provided with transverse rigidification elements.

Each pocket 3 is provided transversely to the covering 1, which is to say, in the direction of the weft threads and extends from one edge to the other of the covering, as shown in FIG. 2.

The pockets 3 are provided from place to place, at regular intervals.

The pockets 3 receive, at the moment of weaving or thereafter, an elongated rigidification element 4, such as a bar for example of composite material of several tens of millimeters in diameter.

The bars 4, for example of the type of glass fibers and polyester resin and 25 mm in diameter, are trapped in the pockets 3 between the two woven structures 1, 2 and give to the covering an increased load bearing capability whilst reinforcing the projecting nature of the regions S in which said bars 4 are inserted.

The material, the diameter and length of the bars 4 can vary. If desired, several bars 4, of reduced diameter, can be inserted in a same pocket 3.

The nature and the diameter of the threads of the woven structure 2 can of course vary, according to the envisaged uses.

The nature of the structure 1 is according to what is given in said patent No. 2.718.158.

FIG. 2 shows a covering according to the invention with transverse rigidification elements 4.

Figure 3:
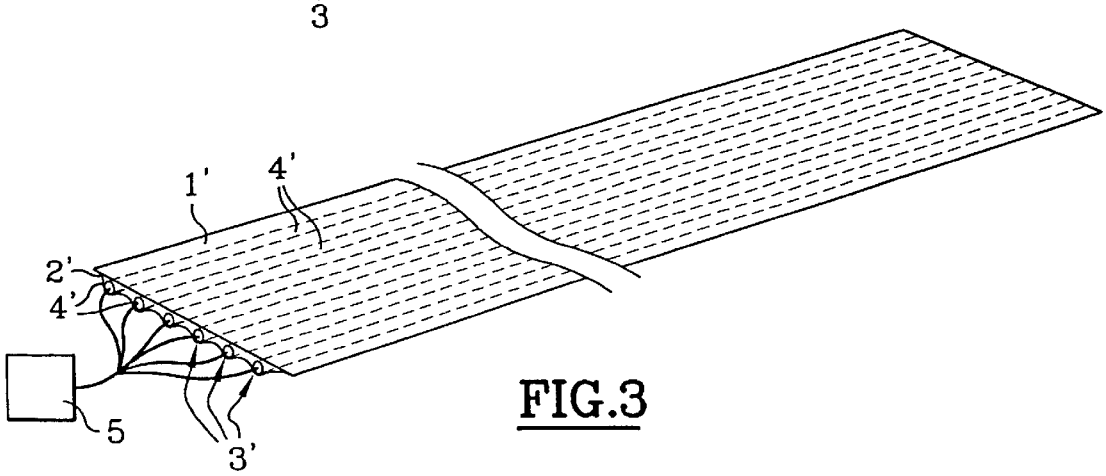
FIG. 3 is a perspective view of a covering according to the invention provided with longitudinal rigidification elements.

FIG. 3 shows a covering according to the invention with rigidification elements 4' inserted in pockets 3' along the longitudinal axis of the covering 1', which is to say in the direction of the warp threads of the woven structure of said covering.

The pockets 3' are also made in the manner described above, by conventional means, in the course of weaving and assembly of the two woven structures (1', 2'). They can receive rigidification elements 4', in particular flexible tubes, for example of 70 mm in diameter, which can be inflated with the help of a fluid under pressure, such as water, from a suitable source 5.

The tubes 4' extend from one end to the other of the covering 1' and, inflated for example with water under a pressure of 6 to 8 bars, give to the assembly a remarkable rigidity and stability, making it unnecessary in certain cases to secure the covering to the ground.

The inflation with water of the tubes 4' also permits deploying the assembly 1', 2' on an extent of water, to permit crossing a body of water for example, the assembly immersing itself without trouble and coming to rest on the bottom.

In an application of the invention to safety, for example the detection of possible mines on the path of vehicles and/or personnel, or the detection of other dangers such as the subsurface presence of cavities, the covering (1, 1') can be provided with devices or means disposed in the pockets (3, 3') ensuring the detection of the cavities or mines and if desired their destruction.

Any other measuring apparatus can be disposed in said pockets.

These same pockets can be provided with self-destructing means rendering the covering unusable after use.

What is claimed is:

1. A temporary surface covering for supporting vehicles moving over sandy, muddy, or marshy ground, with an improved load bearing capacity, comprising:

a first woven layer comprised of first warp threads running along a longitudinal axis and first weft threads running transverse to, and woven with, the first warp threads, the first woven layer having a weave where each warp thread intersects with following weft threads in alternating simple weave regions and float regions, the alternating simple weave regions and float regions providing an embossed structure with transverse ribs formed by projections and hollows;

a second woven layer comprised of second warp threads running along the longitudinal axis and second weft threads running transverse to, and woven with, the second warp threads, the first and second warp threads running in parallel with each other, the first and second weft threads running in parallel with each other, the first and second warp threads being interwoven with the first and second weft threads to superimpose the second woven layer on the first woven layer forming i) interwoven regions wherein the first and second layers are interwoven and ii) non-interwoven regions wherein the first and second layers are not interwoven;

tubular pockets located between the first and second woven layers at the non-interwoven regions; and support elements inserted in the pockets, wherein the transverse ribs are located at least between the tubular pockets.

2. The surface of claim 1, wherein the first and second woven layers are exterior surfaces of the surface covering.

3. The surface covering of claim 1, wherein the support element is a bar.

4. The surface covering of claim 1, wherein the support elements is a bar of composite material.

5. The surface covering of claim 3, wherein the bar has a diameter of several tens of millimeters.

6. The surface covering of claim 1, wherein the tubular pockets are transverse to the longitudinal axis and the support elements are bars.

7. The surface covering of claim 1, wherein the tubular pockets are located along the longitudinal axis.

8. The surface covering of claim 7, wherein the support elements are flexible tubes inflatable by pressure.

9. The surface covering of claim 8, wherein the tubes have a diameter of 70 mm and the tubes are inflatable by a fluid under pressure.

10. The surface covering of claim 9, wherein the fluid is water under a pressure of 6 to 8 bars.

11. The surface covering of claim 1, wherein the weave of the first woven layer has each warp thread intersecting the following weft threads in approximately half of intersections of rows and columns of the weave and has the warp thread being left at remaining intersections.

12. The surface covering of claim 1, wherein the support elements are bars comprising glass fibers and polyester fibers, the bars having a diameter of approximately 25 mm.

13. The surface covering of claim 3, wherein plural bars are located in each of the tubular pockets.

14. The surface covering of claim 1, wherein the tubular pockets containing the support elements create projections on the woven layers.

15. The surface covering of claim 1, wherein the transverse ribs are located at the tubular pockets.

16. A temporary surface covering for supporting vehicles moving over sandy, muddy, or marshy ground, comprising:

a first woven structure (1);

a second auxiliary woven structure (2) superimposed on the first woven structure, the first woven structure formed of first warp threads intertwined with first weft threads, for each first warp thread, there being alternating weave regions and regions of floats, the alternating weave regions and float regions providing an embossed structure with transverse ribs comprised by projections and hollows, the second auxiliary woven structure formed of a layer of second warp threads and a layer of second weft threads, the second warp threads and the second weft threads of the second auxiliary woven structure being parallel to the first warp threads and first weft threads of the first structure, the first and second warp and weft threads being periodically interwoven forming interwoven regions and non-interwoven regions, the non-interwoven regions forming tubular pockets oriented in a direction of either the warp threads or the weft threads; and a support element contained within each tubular pocket sized for supporting vehicles traveling over the covering, wherein the transverse ribs are located at least between the tubular pockets.

17. The surface covering of claim 16, wherein the non-interwoven regions forming tubular pockets are oriented in the direction of the warp threads.

18. The surface covering of claim 16, wherein the non-interwoven regions forming tubular pockets are oriented in the direction of the weft threads.

19. The surface covering of claim 16, wherein the transverse ribs are located at the tubular pockets.

* * * * *